US009649739B2

(12) United States Patent
Maeda et al.

(10) Patent No.: US 9,649,739 B2
(45) Date of Patent: May 16, 2017

(54) POLISHING APPARATUS

(71) Applicant: EBARA CORPORATION, Tokyo (JP)

(72) Inventors: Kazuaki Maeda, Tokyo (JP); Tamami Takahashi, Tokyo (JP); Masaya Seki, Tokyo (JP); Hiroaki Kusa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 14/828,972

(22) Filed: Aug. 18, 2015

(65) Prior Publication Data

US 2015/0352682 A1 Dec. 10, 2015

Related U.S. Application Data

(62) Division of application No. 12/379,983, filed on Mar. 5, 2009, now Pat. No. 9,138,854.

(30) Foreign Application Priority Data

Mar. 6, 2008 (JP) ..... 2008-055946

(51) Int. Cl.

| | |
|---|---|
| ***B24B 21/00*** | (2006.01) |
| ***B24B 41/06*** | (2012.01) |
| ***B24B 9/06*** | (2006.01) |
| ***B24B 21/06*** | (2006.01) |
| ***B24B 21/08*** | (2006.01) |
| ***B24B 37/04*** | (2012.01) |

(52) U.S. Cl.

CPC ..... *B24B 21/002* (2013.01); *B24B 9/065* (2013.01); *B24B 21/004* (2013.01); *B24B 21/06* (2013.01); *B24B 21/08* (2013.01); *B24B 37/04* (2013.01); *B24B 41/06* (2013.01)

(58) Field of Classification Search

CPC ..... B24B 21/002; B24B 21/004; B24B 21/06; B24B 21/08; B24B 9/065; B24B 37/04; B24B 37/06

See application file for complete search history.

(56) References Cited

U.S. PATENT DOCUMENTS

| | | | |
|---|---|---|---|
| 5,443,415 | A | 8/1995 | Shebanow et al. |
| 5,569,063 | A | 10/1996 | Morioka et al. |
| 5,584,752 | A | 12/1996 | Mizutani |

(Continued)

FOREIGN PATENT DOCUMENTS

| | | |
|---|---|---|
| JP | 02-009562 | 1/1990 |
| JP | 06-000758 | 1/1994 |

(Continued)

*Primary Examiner* — Dung Van Nguyen

(74) *Attorney, Agent, or Firm* — Wenderoth, Lind & Ponack, L.L.P.

(57) ABSTRACT

A polishing apparatus polishes a periphery of a substrate by bringing a polishing tool into sliding contact with the substrate. The polishing apparatus includes a substrate-holding mechanism configured to hold a substrate and rotate the substrate, a polishing mechanism configured to press a polishing tool against a periphery of the substrate so as to polish the periphery, and a periphery-supporting mechanism configured to support the periphery of the substrate by a fluid. The periphery-supporting mechanism is configured to support a surface of the substrate from an opposite side or the same side of the periphery of the substrate.

12 Claims, 10 Drawing Sheets

(56) References Cited

U.S. PATENT DOCUMENTS

| | | | | |
|---|---|---|---|---|
| 5,964,646 | A * | 10/1999 | Kassir | B24B 7/228 451/289 |
| 6,050,880 | A * | 4/2000 | Kato | B24B 37/30 451/287 |
| 6,165,057 | A * | 12/2000 | Gill, Jr. | B24B 37/005 451/287 |
| 6,402,596 | B1 | 6/2002 | Hakomori et al. | |
| 6,511,362 | B1 * | 1/2003 | Akaike | B24B 27/0084 451/290 |
| 6,592,435 | B2 | 7/2003 | Kishima | |
| 6,857,950 | B2 | 2/2005 | Hayashi et al. | |
| 7,066,787 | B2 | 6/2006 | Nakanishi et al. | |
| 7,108,582 | B2 | 9/2006 | Sato et al. | |
| 7,682,225 | B2 | 3/2010 | Hongo et al. | |
| 8,066,550 | B2 * | 11/2011 | Higuchi | B24B 9/065 451/285 |
| 2003/0008602 | A1 * | 1/2003 | Ashjaee | B24B 37/30 451/54 |
| 2006/0019417 | A1 * | 1/2006 | Shigeta | B24B 37/013 438/14 |
| 2008/0293336 | A1 | 11/2008 | Zhang et al. | |
| 2010/0022166 | A1 * | 1/2010 | Kimba | B24B 9/065 451/5 |

FOREIGN PATENT DOCUMENTS

| | | |
|---|---|---|
| JP | 2001-205549 | 7/2001 |
| JP | 2003-234314 | 8/2003 |
| JP | 2004-103825 | 4/2004 |
| JP | 2004-241434 | 8/2004 |
| JP | 2005-277050 | 10/2005 |
| JP | 2005-305586 | 11/2005 |
| JP | 2007-189208 | 7/2007 |
| JP | 2007-208161 | 8/2007 |
| JP | 2008-119768 | 5/2008 |
| WO | 2006/112532 | 10/2006 |

* cited by examiner

POLISHING APPARATUS

BACKGROUND OF THE INVENTION

Field of the Invention

The present invention relates to a polishing apparatus for polishing a periphery, including a flat portion, of a substrate.

Description of the Related Art

In semiconductor device fabrication, a wafer is used as a substrate. Processes of fabricating the semiconductor device include sequential film forming processes and film removing processes. As the film forming processes and the film removing processes are repeated, a periphery of the wafer becomes rough. As a result, fine contaminants, which are called particles, are produced from the roughed surface.

If the contaminants are left on the substrate, part of the contaminants can move from the periphery to a central portion of a surface of the wafer through transferring and processing of the wafer. Devices are typically formed in a grid pattern on the surface of the wafer. If the contaminants are attached to the devices, quality of the devices is lowered, resulting in defective products. In order to avoid such problems, it is necessary to process the periphery of the wafer.

As described above, in the fabrication processes of the semiconductor device, multiple films are formed on the wafer. In the film forming processes, there is a need to remove only a periphery of a film formed on the wafer. For example, after a certain film is formed, the wafer is transferred to the subsequent process, with the periphery of the wafer being held by a transfer robot. During the transferring of the wafer, the film on the periphery of the wafer could adhere to the transfer robot. This film could spread as contaminants in the subsequent processes. To avoid such spread of the contaminants, the portion of the wafer where the transfer robot grabs (i.e., the periphery of the wafer) is processed in advance, so that the film is removed from the periphery of the wafer.

One of the methods of processing the periphery of the wafer is a polishing process. The polishing process is classified roughly into two types: a one-side polishing method and a both-side polishing method. The one-side polishing method is performed by bringing a polishing tool into contact with a substrate from one side of the substrate. On the other hand, the both-side polishing method is performed by bringing a polishing tool into contact with a substrate from both sides of the substrate. Japanese laid-open patent publication No. 2001-205549 discloses a one-side polishing method performed by bringing a polishing cloth into contact with a substrate from one side of the substrate. In this patent publication, the polishing cloth applies a downward force to the periphery of the substrate, while the polishing cloth is moved from the periphery to the center of the substrate. Japanese laid-open patent publication No. 2007-208161 discloses another one-side polishing method that is performed by applying a downward force from a polishing drum to an upper bevel of a substrate. Japanese laid-open patent publication No. 2005-305586 discloses still another one-side polishing method that is performed by pressing a polishing tape against a periphery of a substrate from above or below the substrate. In these three methods, the pressing force can bend the periphery of the substrate. As a result, it is difficult to polish the periphery while keeping the polishing tool parallel to a flat portion of the periphery of the substrate.

Japanese laid-open patent publications No. 2005-277050 and No. 2007-189208 disclose a both-side polishing method performed by bringing a polishing tool into contact with a wafer from both sides of the wafer. According to this polishing method, the wafer is not bent, because the polishing tool holds the wafer from both sides of the wafer. However, in these two methods, a polishing surface of the polishing tool and a surface of the wafer are not parallel to each other. As a result, it is difficult to uniformly polish the flat surface of the periphery of the wafer while keeping an angle of the flat surface.

Japanese laid-open patent publication No. 2004-241434 discloses a solution to the above-mentioned problems. This polishing method is performed by bringing a polishing tool into contact with a periphery of a wafer from right above and right below the wafer. This method does not bend the wafer and is therefore suitable for planarizing the periphery of the wafer. However, this polishing method inevitably processes both an upper periphery and a lower periphery of the wafer, and cannot satisfy the need to polishing only a periphery at one side of the wafer.

SUMMARY OF THE INVENTION

The present invention has been made in view of the above drawbacks. It is therefore an object of the present invention to provide a polishing apparatus capable of polishing a periphery at one side of a substrate while maintaining an original angle of the peripheral surface of the substrate.

One aspect of the present invention for achieving the above object is to provide a polishing apparatus including a substrate-holding mechanism configured to hold a substrate and rotate the substrate, a polishing mechanism configured to press a polishing tool against a periphery of the substrate so as to polish the periphery, and a periphery-supporting mechanism configured to support the periphery of the substrate by a fluid.

In a preferred aspect of the present invention, the periphery-supporting mechanism is configured to support a surface of the substrate from an opposite side of the periphery of the substrate.

In a preferred aspect of the present invention, the periphery-supporting mechanism is configured to support a surface of the substrate from the same side of the periphery of the substrate.

In a preferred aspect of the present invention, the polishing apparatus further includes a moving mechanism configured to move the polishing mechanism in a radial direction of the substrate held on the substrate-holding mechanism.

In a preferred aspect of the present invention, the polishing tool comprises a polishing tape, and the polishing apparatus further includes a polishing-tape supply mechanism configured to supply the polishing tape to the polishing mechanism.

Another aspect of the present invention is to provide a polishing apparatus including a substrate-holding mechanism configured to hold a substrate and rotate the substrate, a polishing mechanism configured to press a polishing tool against a periphery of the substrate so as to polish the periphery, and a pressing-force adjustor configured to keep a pressing force of the polishing mechanism constant.

In a preferred aspect of the present invention, the polishing mechanism has a press pad adapted to press the polishing tool against the periphery of the substrate, the press pad having a liquid enclosed therein.

DETAILED DESCRIPTION OF THE PREFERRED EMBODIMENTS

Embodiments of the present invention will be described below with reference to the drawings.

Figure 1:
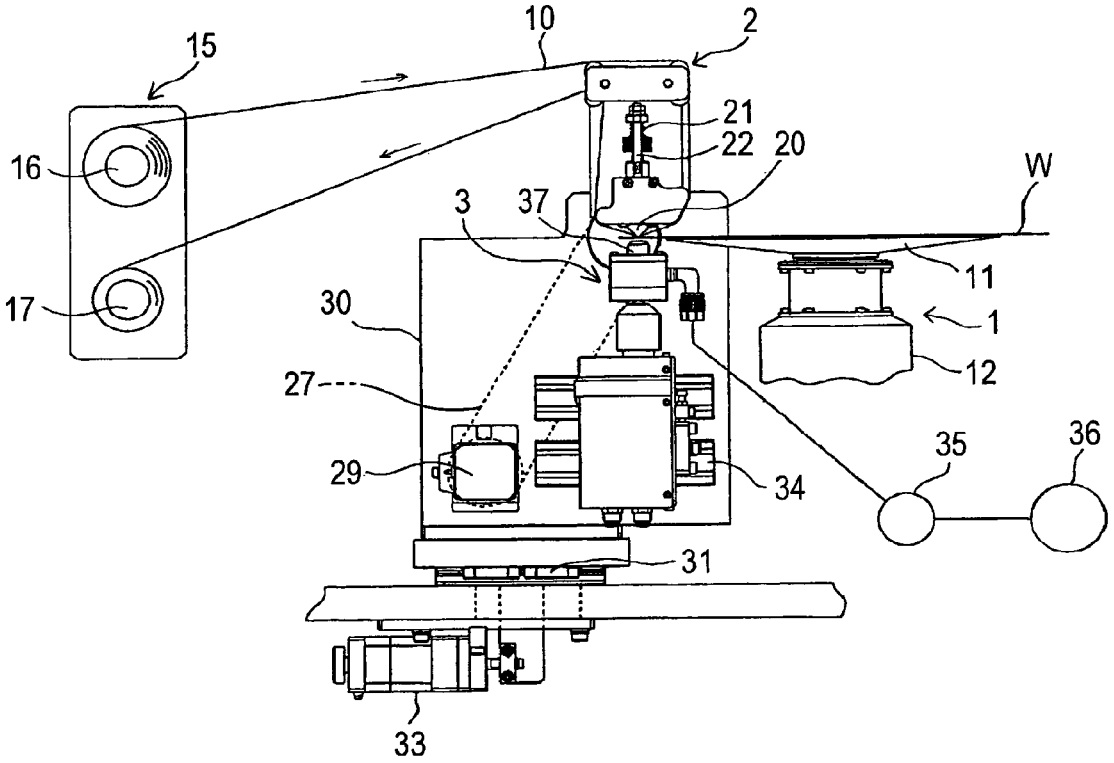
FIG. 1 is a front view schematically showing a polishing apparatus according to a first embodiment of the present invention.

FIG. 1 is a front view schematically showing a polishing apparatus according to a first embodiment of the present invention. As shown in FIG. 1, the polishing apparatus includes a substrate-holding mechanism 1 configured to hold a substrate (e.g., a wafer) W horizontally and rotate the substrate W, a polishing mechanism 2 configured to polish a periphery of the substrate W held by the substrate-holding mechanism 1, and a periphery-supporting mechanism 3 configured to support the periphery of the substrate W held by the substrate-holding mechanism 1. In this specification, the periphery of the substrate is defined as a flat portion ranging from an outermost edge to a radially inward portion of the substrate.

The substrate-holding mechanism 1 has a substrate stage 11 configured to hold the substrate W by a vacuum suction or the like and a substrate-holding mechanism 12 configured to rotate the substrate stage 11. The substrate stage 11 has a diameter smaller than the substrate W, and holds the substrate W with the periphery of the substrate W (i.e., a portion to be polished) lying outwardly of the substrate stage 11. The substrate-holding mechanism 12 has a motor (not shown in the drawing), which is coupled to the substrate stage 11. With this configuration, the rotation of the motor of the substrate-holding mechanism 12 rotates the substrate W, held on the substrate stage 11, in a horizontal plane.

The polishing mechanism 2 is a device for pressing the polishing tape (polishing tool) 10 against an upper periphery of the substrate W to thereby polish the periphery. In this embodiment, the polishing tape 10 is used as the polishing tool. The polishing tape 10 may comprise a base film having a polishing surface to which abrasive particles, such as diamond particles or SiC particles, are attached. The surface of the polishing tape 10 holding the abrasive particles serves as the polishing surface. The abrasive particles to be used in the polishing tape 10 are selected in accordance with a type of wafer and a polishing performance required. For example, the abrasive particles may be diamond particles or SiC particles having an average diameter in a range of 0.1 μm to 5.0 μm. The polishing tape 10 may be a belt-shaped polishing cloth with no abrasive particles. The base film may comprise a film made from a flexible material, such as polyester, polyurethane, or polyethylene terephthalate.

The substrate-holding mechanism 1, the polishing mechanism 2, and the periphery-supporting mechanism 3 are arranged in a housing (not shown in the drawing). An inner space of the housing provides a polishing chamber. The polishing tape 10 is supplied from a polishing-tape supply mechanism 15 to the polishing mechanism 2. This polishing-tape supply mechanism 15 is located outside of the polishing chamber. The polishing-tape supply mechanism 15 is secured to the housing or a frame (not shown in the drawing), and its position is fixed. The polishing-tape supply mechanism 15 has a tape-feeding mechanism 16 and a tape-winding mechanism 17. The polishing tape 10 is fed from the tape-feeding mechanism 16 to the polishing mechanism 2, and recovered from the polishing mechanism 2 by the tape-winding mechanism 17. The polishing tape 10 is supplied little by little to the polishing mechanism 2, so that a new polishing surface is provided continuously for polishing of the substrate W.

The polishing mechanism 2 has a press pad 20 arranged behind the polishing tape 10 (i.e., arranged at an opposite side of the polishing surface of the polishing tape 10), and a spring 21 as a pressing mechanism for applying a pressing force to the press pad 20. The press pad 20 is secured to a tip end of a rod 22, which is supported slidably in its longitudinal direction by a bearing (not shown in the drawing). The pressing force is exerted on the press pad 20 by the spring 21 via the rod 22, thereby pressing the polishing tape 10 against a surface of the substrate W. This pressing force applied to the polishing tape 10 is adjusted by the spring 21, so that a constant pressing force is obtained at all times. Examples of a material constituting the press pad 20 include an elastic material, such as silicon rubber, silicon sponge, and fluoro rubber, or a hard material such as poly butylenes naphthalate (PBN), fluororesin, and polyetheretherketone (PEEK).

Figure 2:
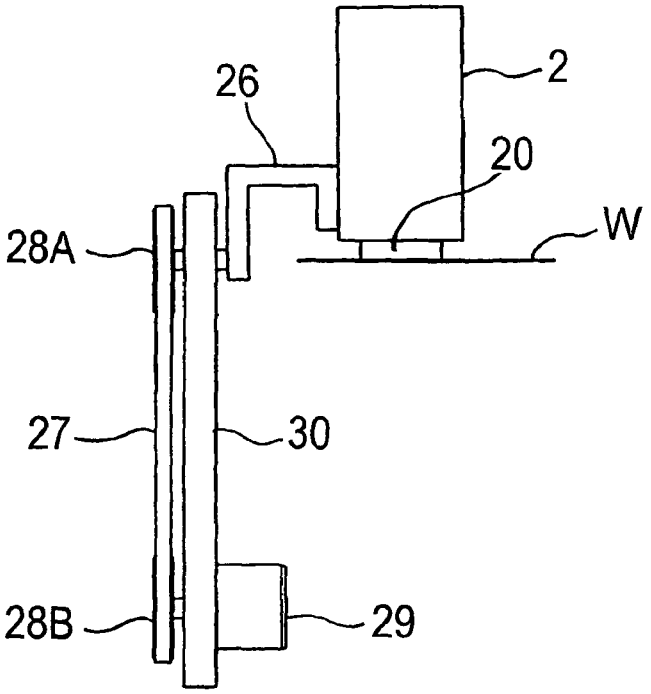
FIG. 2 is a side view showing a tilting mechanism for tilting a polishing mechanism.

FIG. 2 is a side view showing a tilting mechanism for tilting the polishing mechanism 2. The polishing mechanism 2 is coupled to a motor 29 via an arm 26, a belt 27, and pulleys 28A and 28B, so that the polishing mechanism 2 is rotated by the motor 29 about an outermost end of the substrate W held on the substrate-holding mechanism 1. The arm 26, the belt 27, the pulleys 28A and 28B, and the motor 29 constitute the tilting mechanism for tilting the polishing mechanism 2.

The polishing mechanism 2 is supported by a plate 30 via the tilting mechanism. The plate 30 is installed on a slide mechanism 31. This slide mechanism 31 is configured to allow the plate 30 to move in a longitudinal direction of the slide mechanism 31. The plate 30 is coupled to a linear actuator 33. This linear actuator 33 is configured to cause the polishing mechanism 2 to move in a radial direction of the substrate W held on the substrate-holding mechanism 1. Therefore, the linear actuator 33 serves as a moving mechanism for moving the polishing mechanism 2 in the radial direction of the substrate W.

The polishing mechanism 2 is arranged above the substrate W held on the substrate-holding mechanism 1, and the periphery-supporting mechanism 3 is arranged below the substrate W. Specifically, the arrangement of the polishing mechanism 2 and the periphery-supporting mechanism 3 is substantially symmetric about the substrate W. The periphery-supporting mechanism 3 is to support the periphery of the substrate W, pressed by the polishing mechanism 2, from an opposite side of the periphery of the substrate W using pressure of a fluid, as discussed below.

The periphery-supporting mechanism 3 is coupled to the plate 30 via a slide mechanism 34. This slide mechanism 34 is coupled to a linear actuator (not shown in the drawing) mounted on the plate 30. With this configuration, the periphery-supporting mechanism 3 is movable in the radial direction of the substrate W independently of the polishing mechanism 2. The periphery-supporting mechanism 3 is coupled to a liquid supply source 36 via a pressure-reducing valve 35. A liquid is adjusted in its pressure by the pressure-reducing valve 35 and supplied to the periphery-supporting mechanism 3. The periphery-supporting mechanism 3 has a nozzle 37 located near a lower periphery of the substrate W. The liquid, whose pressure is adjusted by the pressure-reducing valve 35, is ejected through the nozzle 37 toward the lower periphery of the substrate W. Pure water is preferably used as the liquid.

Next, operations of the polishing apparatus according to the embodiment of the present invention will be described.

The substrate W is transferred to the polishing chamber of the polishing apparatus by a transfer robot (not shown in the drawing), and placed onto the substrate stage 11 of the substrate-holding mechanism 1. The substrate-holding mechanism 1 holds the substrate W by the vacuum suction or the like, and rotates the substrate W in the horizontal plane. The polishing-tape supply mechanism 15 feeds the polishing tape 10 from the tape-feeding mechanism 16 to the polishing mechanism 2, and winds the polishing tape 10 on the tape-winding mechanism 17. The polishing tape 10 is pressed against the upper periphery of the substrate W, while the polishing tape 10 is traveling in its longitudinal direction. Simultaneously, the liquid is ejected from the nozzle 37 of the periphery-supporting mechanism 3 toward the lower periphery of the substrate W.

The rotating substrate W and the polishing tape 10 are moved relative to each other, and as a result the polishing surface of the polishing tape 10 is brought into sliding contact with the substrate W. During polishing, the polishing mechanism 2 and the periphery-supporting mechanism 3 are moved by the linear actuator 33 in the radial direction of the substrate W. If necessary, an angle of the polishing mechanism 2 with respect to the substrate W may be changed by the tilting mechanism. It is preferable to supply pure water onto the upper periphery (a portion to be polished) of the substrate W so as to prevent scattering of particles produced by polishing.

Figure 3A:
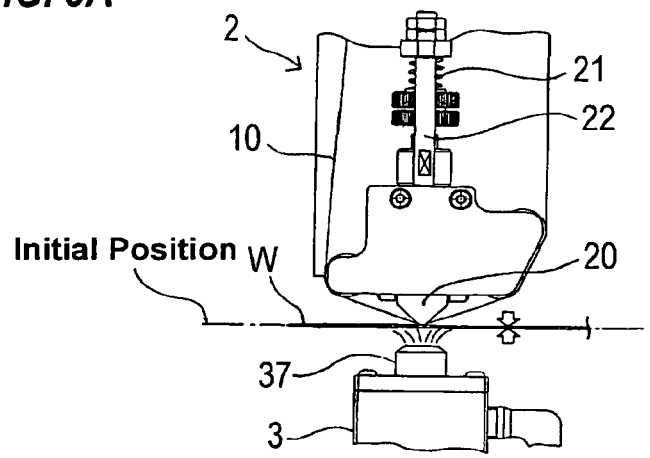
FIG. 3A through FIG. 3C are views showing a positional relationship between a substrate and a periphery-supporting mechanism.
Figure 3B:
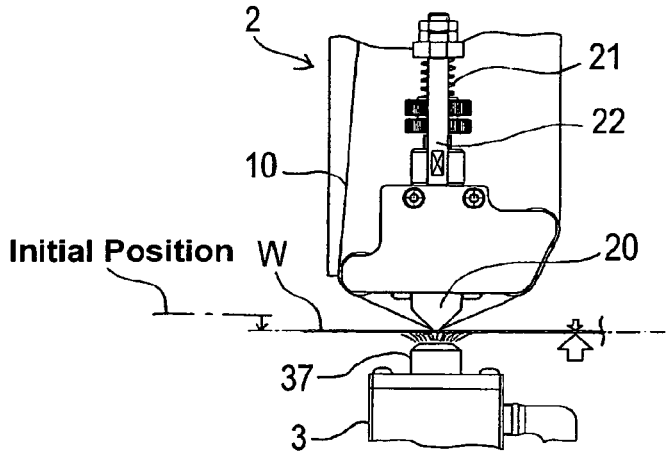
Figure 3C:
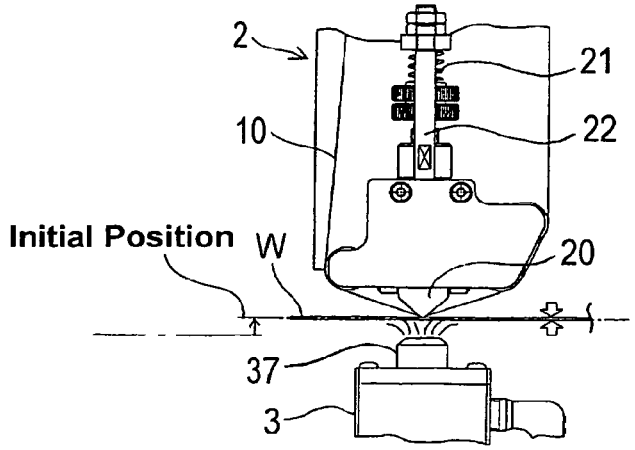

FIG. 3A through FIG. 3C are views showing a positional relationship between the substrate W and the periphery-supporting mechanism 3. As a gap between the substrate W and the nozzle 37 becomes smaller, a flow rate of the liquid becomes smaller and pressure of the liquid becomes larger. Therefore, as shown in FIG. 3A, the nozzle 37 is located as close to the substrate W as possible. FIG. 3A shows an initial position of the substrate W. In this initial position, a pressing force of the polishing mechanism 2 and a pressing force of the liquid from the nozzle 37 are balanced.

When the gap between the substrate W and the nozzle 37 becomes smaller than the initial gap as a result of a downward displacement of the substrate W due to fluctuating rotation thereof or other causes, the pressure of the liquid between the substrate W and the nozzle 37 becomes large (see FIG. 3B). At this time, the spring 21 expands, whereby the pressing force applied from the polishing mechanism 2 to the substrate W becomes small. As a result, the upward force and the downward force are out of balance, and the substrate W is forced back upwardly by the liquid. Finally, the substrate W is returned to the initial position (see FIG. 3C).

Figure 4A:
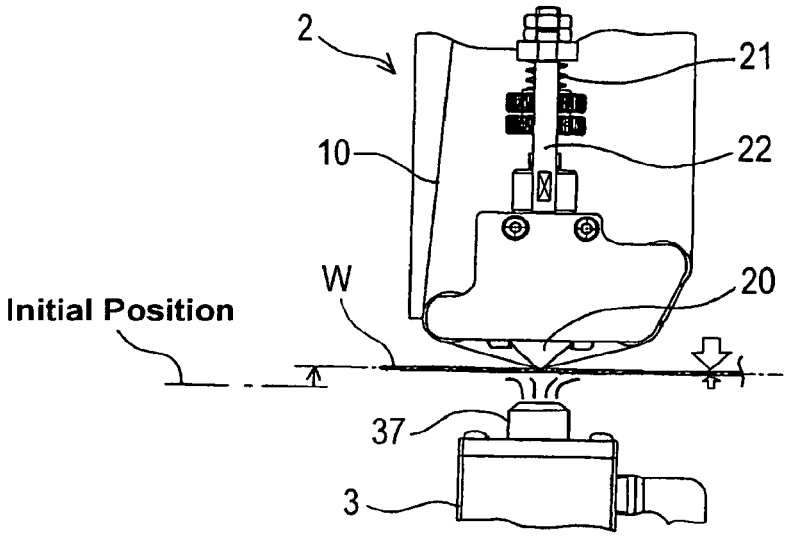
FIGS. 4A and 4B are views showing a positional relationship between the substrate and the periphery-supporting mechanism.
Figure 4B:
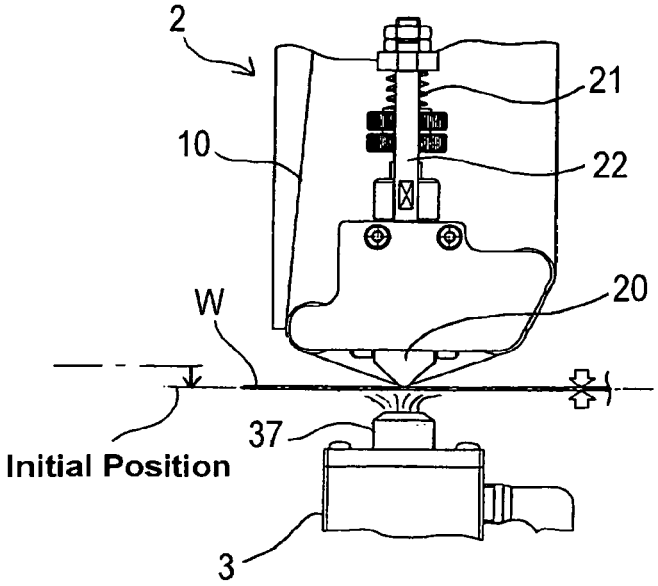

When the substrate W is displaced upwardly, the substrate W is returned to the initial position according to the same mechanism as well. Specifically, as shown in FIG. 4A, when the substrate W is displaced upwardly, the gap between the substrate W and the nozzle 37 becomes large and the pressing force of the liquid from the nozzle 37 becomes small. Simultaneously, the spring 21 is compressed to increase the pressing force applied from the polishing mechanism 2 to the substrate W. As a result, the upward force and the downward force acting on the substrate W are unbalanced, and the substrate W is forced back downwardly to its initial position (see FIG. 4B).

In this manner, even when the substrate W is displaced upwardly and downwardly, the substrate W is returned to its initial position. Therefore, the substrate W is not bent and is therefore pressed by the polishing tape (polishing tool) 10 with a constant force at all times. Consequently, the polishing apparatus according to this embodiment can polish the substrate W with its flat surface being maintained as it is. In particular, this structure allows the polishing apparatus to remove only an uppermost film (or desired number of films) from a multilayer film on a substrate.

Figure 5:
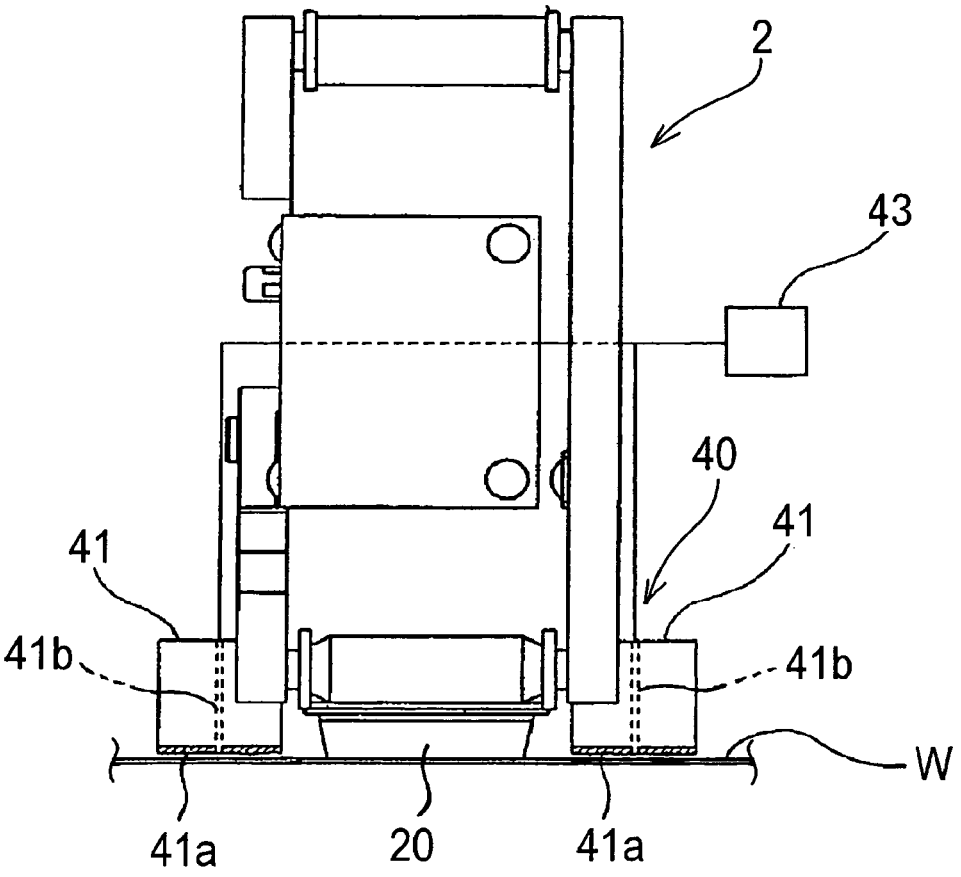
FIG. 5 is a side view showing an essential part of a polishing apparatus according to a second embodiment of the present invention as viewed from a radial direction of the substrate.

Next, a polishing apparatus according to a second embodiment of the present invention will be described. FIG. 5 is a side view showing an essential part of the polishing apparatus according to the second embodiment of the present invention as viewed from the radial direction of the substrate. The polishing apparatus according to the second embodiment is different from the first embodiment in that a periphery-supporting mechanism 40 is located at the same side of the periphery to be polished. Other structures and operations of the second embodiment are identical to those of the first embodiment.

As shown in FIG. 5, the periphery-supporting mechanism 40 is mounted on a lower portion of the polishing mechanism 2, and is movable integrally with the polishing mechanism 2. The periphery-supporting mechanism 40 includes two substrate-support members 41 and 41 each having a flat support surface (lower surface) 41*a* facing the upper periphery of the substrate W. Each of the substrate-supporting members 41 has a capillary 41*b*. One open end of the capillary 41*b* lies in the support surface 41*a* and the other open end is coupled to a liquid supply source 43. The substrate-support members 41 and 41 are arranged along a circumferential direction of the substrate W so as to interpose the press pad 20 therebetween. While the two substrate-support members 41 are provided, one or more than two substrate-support members may be provided.

A liquid is supplied from the liquid supply source 43 to the capillaries 41*b* and flows out at a high velocity from the open end formed in the support surfaces 41*a*. The liquid flows at a high velocity through gaps between the support surfaces 41*a* and an upper surface of the substrate W. When the velocity of the liquid is high, negative pressure is developed in the gaps between the support surfaces 41*a* and the substrate W according to Bernoulli's theorem, whereby the substrate W is supported by the substrate-support members 41 and 41 from the same side of the periphery to be polished. With this structure, the substrate W can be supported from the polishing side.

Figure 6:
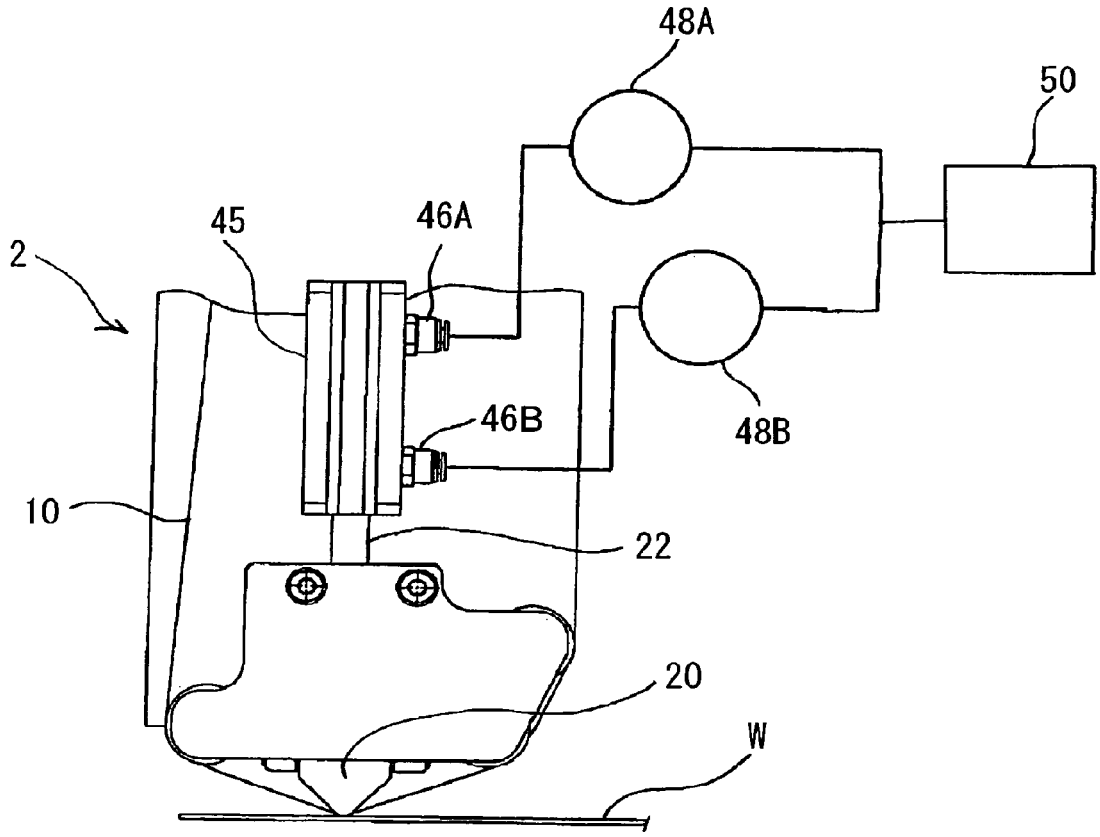
FIG. 6 is a front view showing an essential part of a polishing apparatus according to a third embodiment of the present invention.

Next, a polishing apparatus according to a third embodiment of the present invention will be described. FIG. 6 is a front view showing an essential part of the polishing apparatus according to the third embodiment of the present invention. The polishing apparatus according to the third embodiment is different from the first embodiment in that the periphery-supporting mechanism is not provided and a pressing-force adjustor for adjusting the pressing force of the polishing mechanism 2 is provided. Other structures and operations of the third embodiment are identical to those of the first embodiment.

As shown in FIG. 6, the end of the rod 22 is housed in a cylinder 45. This cylinder 45 has a first port 46A and a second port 46B arranged in a longitudinal direction of the cylinder 45. The first port 46A and the second port 46B are coupled to a gas supply source 50 via a first electropneumatic regulator 48A and a second electropneumatic regulator 48B, respectively. In this embodiment, the pressing-force adjustor is constituted by the first electropneumatic regulator 48A, the second electropneumatic regulator 48B, the cylinder 45, and the gas supply source 50.

Pressure of a gas to be supplied to the cylinder 45 is adjusted by the first electropneumatic regulator 48A and the second electropneumatic regulator 48B, so that the pressing force (i.e., polishing pressure) applied by the press pad 20 to the substrate W via the polishing tape 10 can be adjusted. More specifically, the pressure of the gas supplied to the cylinder 45 via the first port 46A is kept larger than the pressure of the gas supplied to the cylinder 45 via the second port 46B, while the pressure of the gas supplied to the cylinder 45 via the second port 46B is kept constant. As a result, the polishing pressure can be applied to the substrate W. Further, by adjusting the pressure of the gas to be supplied to the cylinder 45 via the first port 46A while keeping the relationship in the pressures, the polishing pressure can be adjusted.

Figure 7A:
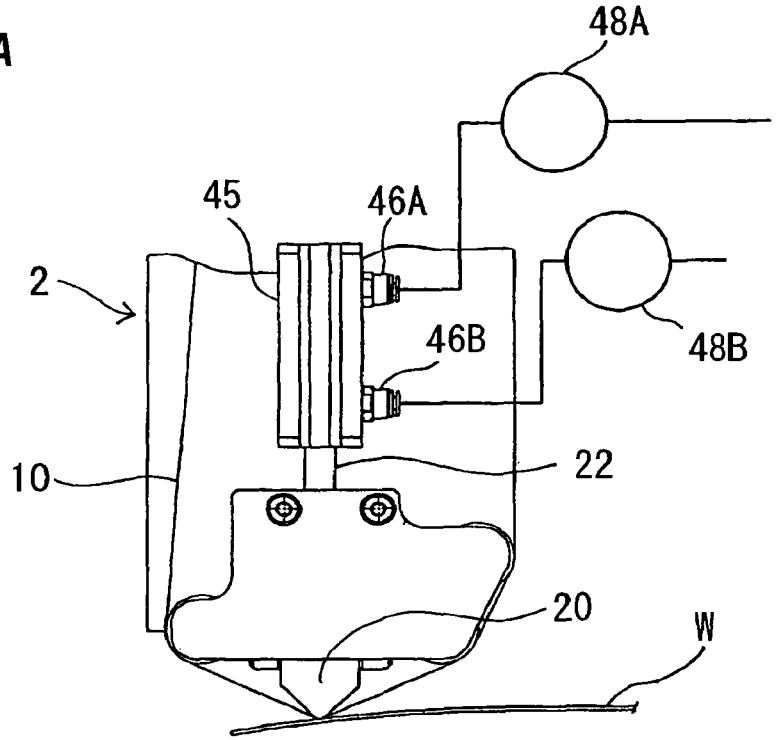
FIG. 7A and FIG. 7B are views each showing a deflection of the substrate that varies in accordance with the radial position of the polishing mechanism.
Figure 7B:
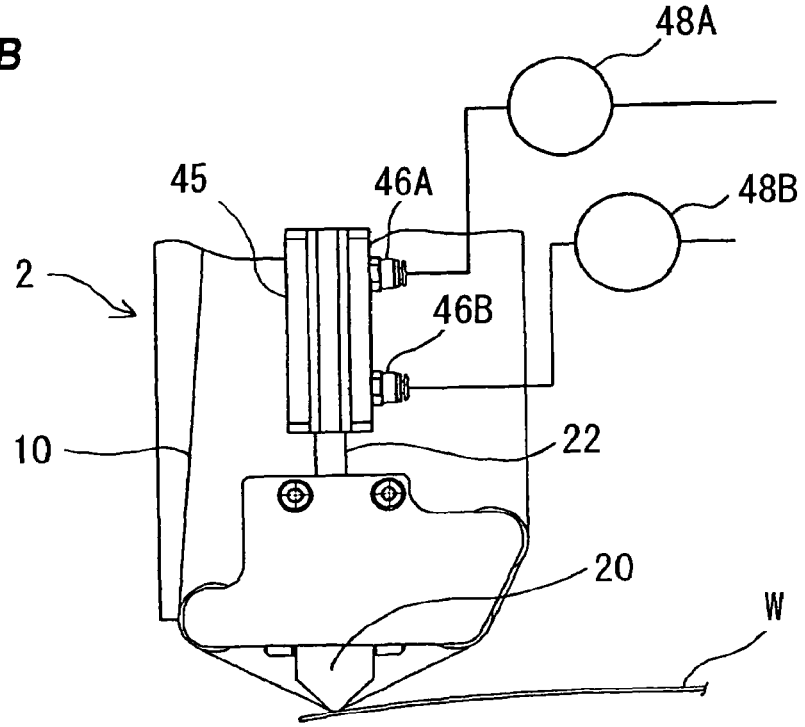

As the contact area between the polishing tape 10 and the substrate W approaches an edge of the substrate W, deflection of the substrate W becomes larger and the polishing pressure becomes smaller. Thus, in this embodiment, the pressure of the gas to be supplied to the cylinder 45 is adjusted by the first electropneumatic regulator 48A and the second electropneumatic regulator 48B so as to keep the polishing pressure constant in all polishing areas, as shown in FIG. 7A and FIG. 7B. This operation makes it possible to polish the periphery of the substrate W at constant polishing pressure at all times.

Figure 8A:
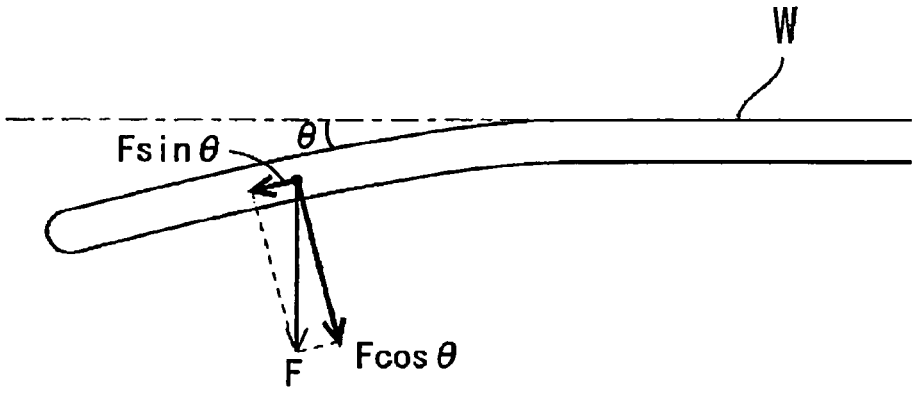
FIG. 8A and FIG. 8B are schematic views illustrating a pressing force applied to the substrate in the radial positions shown in FIG. 7A and FIG. 7B.
Figure 8B:
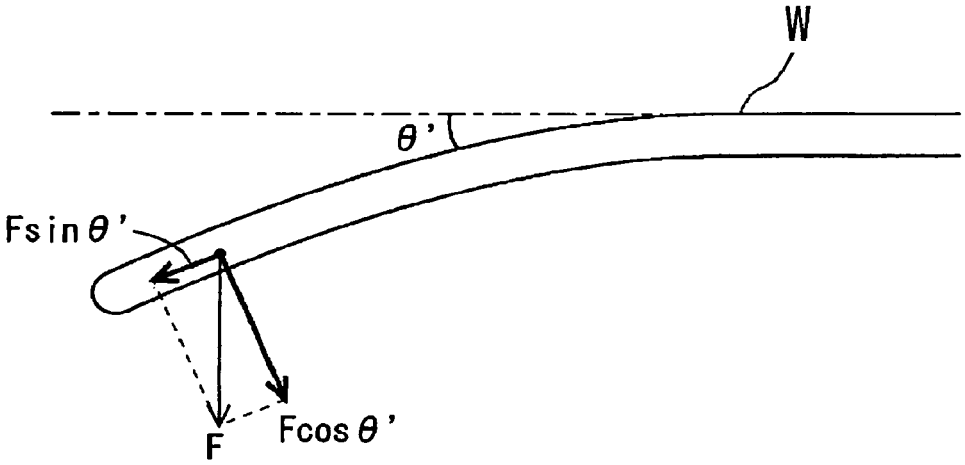

The polishing pressure is adjusted to be constant as follows. FIG. 8A and FIG. 8B are schematic views illustrating pressing forces applied to the substrate at positions as shown in FIG. 7A and FIG. 7B, respectively. As shown in FIG. 8A, when the substrate W is bent, the force F, which is applied to the substrate W from right above, is resolved into a component F cos θ which is perpendicular to the substrate W and a component F sin θ which is parallel to the substrate W. Of these two components, the component F cos, which is perpendicular to the substrate W, acts on polishing of the substrate W. Therefore, it is necessary to keep the component F cos θ constant during movement of the polishing mechanism 2 in the radial direction of the substrate W. An angle of deflection θ can be expressed as a function of the pressing force F and a distance in the radial direction between an application point of the force F and the center of the substrate W, and this function can be obtained by measurement. While the angle of deflection θ varies depending on the pressing force F, it is possible to obtain the pressing force F such that the component F cos θ is kept constant in every radial positions of the substrate W by repetitive calculation using the function. In this manner, the pressing force F cos θ can be kept constant by applying the pressing force F that is adjusted in advance according to the radial position of the substrate W.

Figure 9:
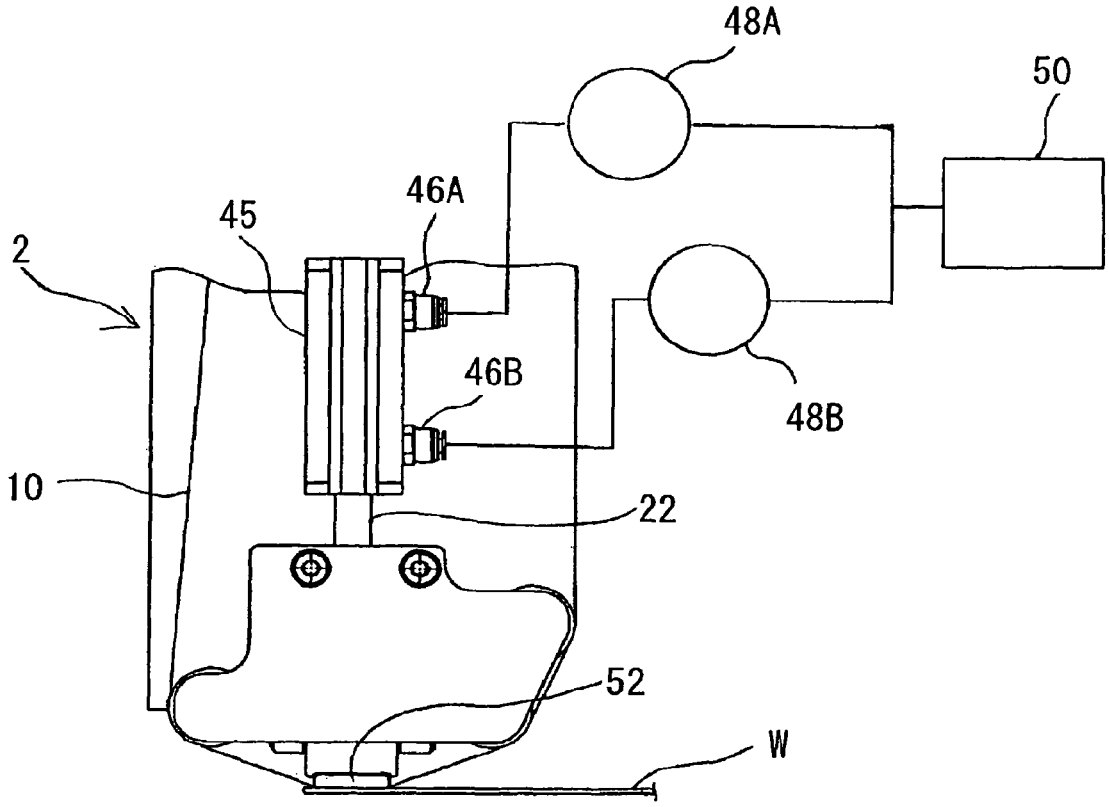
FIG. 9 is a front view showing another example of the polishing apparatus according to the third embodiment of the present invention.
Figure 10:
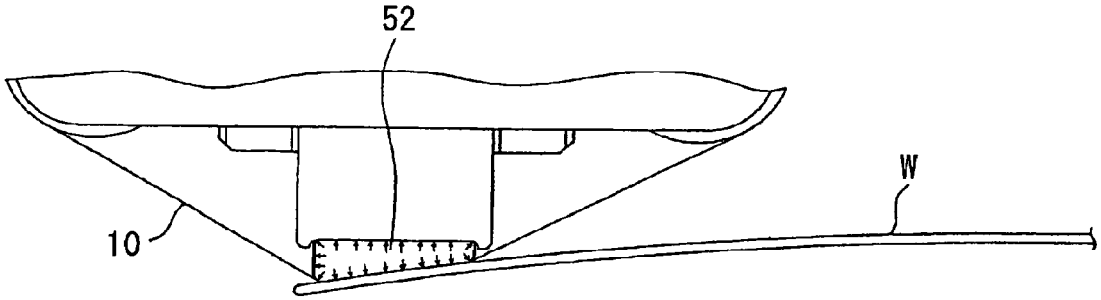
FIG. 10 an enlarged view showing part of the polishing mechanism shown in FIG. 9.

FIG. 9 is a front view showing another example of the polishing apparatus according to the embodiment of the present invention. In this example, a deformable press pad 52 in which a liquid is enclosed is used. As shown in FIG. 10, the deformable press pad 52 can apply a uniform pressing force to the substrate W on the Pascal's principle. Even when the substrate W is bent, a uniform pressing force can be applied from a direction perpendicular to the surface of the substrate W. As a result, the substrate W can be polished with its flat portion of the periphery maintained as it is.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing apparatus comprising:

a substrate-holding mechanism configured to hold a substrate and rotate the substrate, said substrate-holding mechanism having a substrate stage configured to contact a central portion of the substrate;

a polishing mechanism configured to press a polishing tool against a periphery of the substrate so as to polish the periphery; and a periphery-supporting mechanism configured to support the periphery of the substrate by ejecting a fluid toward the periphery.

2. The polishing apparatus according to claim 1, wherein said periphery-supporting mechanism is configured to support a surface of the substrate from an opposite side of the periphery of the substrate.

3. The polishing apparatus according to claim 1, wherein said periphery-supporting mechanism is configured to support a surface of the substrate from the same side of the periphery of the substrate.

4. The polishing apparatus according to claim 1, further comprising:

a moving mechanism configured to move said polishing mechanism in a radial direction of the substrate held on said substrate-holding mechanism.

5. The polishing apparatus according to claim 1, wherein said polishing mechanism is located above the substrate and said periphery-supporting mechanism is located below the substrate, when the substrate is held on said substrate-holding mechanism.

6. The polishing apparatus according to claim 1, wherein said periphery-supporting mechanism is configured not to rotate.

7. A polishing apparatus comprising:

a substrate-holding mechanism configured to hold a substrate and rotate the substrate;

a polishing mechanism configured to press a polishing tape against a periphery of the substrate so as to polish the periphery;

a periphery-supporting mechanism configured to support the periphery of the substrate by a fluid; and a polishing-tape supply mechanism configured to supply the polishing tape to said polishing mechanism.

8. A polishing apparatus comprising:

a substrate-holding mechanism configured to hold a substrate and rotate the substrate;

a polishing mechanism configured to press a polishing tool against a periphery of the substrate so as to polish the periphery; and a periphery-supporting mechanism configured to support the periphery of the substrate by a fluid, wherein said polishing mechanism includes a spring configured to press the polishing tool against the periphery of the substrate so as to polish the periphery.

9. A polishing apparatus comprising:

a substrate-holding mechanism configured to hold a substrate and rotate the substrate;

a polishing mechanism configured to press a polishing tool against a periphery of the substrate so as to polish the periphery; and a periphery-supporting mechanism configured to support the periphery of the substrate by a fluid, wherein said polishing mechanism includes a cylinder and a rod whose end is housed in said cylinder, said cylinder and said rod being configured to press the polishing tool against the periphery of the substrate so as to polish the periphery.

10. A polishing apparatus comprising:

a substrate-holding mechanism configured to hold a substrate and rotate the substrate, said substrate-holding mechanism having a substrate stage configured to contact a central portion of the substrate;

a polishing mechanism configured to press a polishing tool against a periphery of the substrate so as to polish the periphery; and a periphery-supporting mechanism configured to support the periphery of the substrate by a fluid, wherein said periphery-supporting mechanism is movable in a radial direction of the substrate when the substrate is held on said substrate-holding mechanism.

11. A polishing apparatus comprising:

a substrate-holding mechanism configured to hold a substrate and rotate the substrate, said substrate-holding mechanism having a substrate stage configured to contact a central portion of the substrate;

a polishing mechanism configured to press a polishing tool against a periphery of the substrate so as to polish the periphery; and a periphery-supporting mechanism configured to support the periphery of the substrate by a fluid, wherein said substrate stage is rotatable relative to said periphery-supporting mechanism.

12. A polishing apparatus comprising:

a substrate-holding mechanism configured to hold a substrate and rotate the substrate, said substrate-holding mechanism having a substrate stage configured to contact a central portion of the substrate;

a polishing mechanism configured to press a polishing tool against a periphery of the substrate so as to polish the periphery; and a periphery-supporting mechanism configured to support the periphery of the substrate by a fluid, wherein said periphery-supporting mechanism is movable relative to said substrate-holding mechanism.

* * * * *